United States Patent [19]

Smith et al.

[11] Patent Number: 4,972,682

[45] Date of Patent: Nov. 27, 1990

[54] FORCED AIR COOLER

[75] Inventors: Phillip A. Smith; Robert A. Johnson; Michael A. Branz, all of Spartanburg, S.C.

[73] Assignee: Specialty Equipment Companies, Inc., Berkeley, Ill.

[21] Appl. No.: 370,617

[22] Filed: Jun. 23, 1989

[51] Int. Cl.[5] ..... F25D 17/08

[52] U.S. Cl. ..... 62/405; 62/407; 62/415; 62/255

[58] Field of Search ..... 62/255, 256, 440, 405, 62/416, 407, 417

[56] References Cited

U.S. PATENT DOCUMENTS

| | | | |
|---|---|---|---|
| 222,604 | 12/1879 | Scott . | |
| 2,492,695 | 12/1949 | Henderson | 62/255 X |
| 2,657,546 | 11/1953 | Smith | 62/255 X |
| 3,196,632 | 7/1965 | Buffington | 62/281 |
| 3,465,536 | 9/1969 | Vogel et al. | 62/158 |
| 3,756,038 | 9/1973 | MacMaster et al. | 62/256 |
| 3,759,059 | 9/1973 | Kenyon | 62/246 |

OTHER PUBLICATIONS

Beverage-Air School Milk Coolers SM-ST Series Product Brochure 2/88.

Colorpoint Open Front Milk Case Dispenser Product Brochure, 6/23/1989.

*Primary Examiner*—Lloyd L. King

*Attorney, Agent, or Firm*—Dority & Manning

[57] ABSTRACT

A cooler cabinet having a refrigeration system, and particularly devised to maintain articles to-be-cooled, such as milk cartons and the like, and permit the continuous entry into the cabinet enclosure for the removal of the articles is disclosed as having a main chamber for the articles, an upper, separated chamber for enclosing the evaporator for the refrigeration system and a lower, separated chamber for enclosing condenser and compressor. Air distribution fans are positioned in the upper chamber and are arranged to produce circulatory air movement across the evaporator to be cooled thereby in the upper chamber, then downwardly along the front wall of the main chamber then across the floor of the main chamber, then upwardly along the back wall of the chamber in an air return path and back to the vicinity of the evaporator for continued recirculation. Wire grates are positioned on the floor and the front wall along which air is moved downwardly.

9 Claims, 3 Drawing Sheets

FORCED AIR COOLER

BACKGROUND OF THE INVENTION

The present invention relates to forced air coolers and more particularly to coolers which are particularly adapted for use in schools as a milk cooler with easy access to students at the school.

There are various types of milk coolers and dispensers in commercial use at the present time. Some provide access to the interior for removal of small milk cartons by school children. However, these may be categorized as of two basic types, free convection and forced convection, with respect to the arrangements and methods for producing and maintaining refrigeration in the cabinets for the coolers. One of the basic types utilizes an evaporating unit of a refrigeration system at the side ends of the cabinet so that refrigerated air is circulated from one end of the cabinet to the other end. This forced convection arrangement is rather costly for the task involved and is inefficient with respect to circulating air since the flow of air from one end of the cabinet competes with the flow of refrigerated air from the other end. The resultant airflow is turbulent and lacks the uniformity necessary for predictable and usable refrigeration throughout the entire cooler cabinet.

In another forced air arrangement for refrigeration in a milk cooler, the evaporator is located below the floor of the cabinet, and it is driven upwardly across the top of the cabinet and downwardly in circulating fashion. In this arrangement, refrigerated air being driven upwardly competes with the normal gravitational downward flow of cold air. This arrangement does not produce a uniform stream of refrigerated air in a circulating path around the interior of the cooler cabinet.

In the free convection arrangement, the metallic tubing utilized for providing refrigerated air is in contact with a wall of the cooler cabinet which actually and directly produces the refrigerated air. This indirect transfer of a refrigerant to air to be circulated results in the lessening of the production of refrigerated air within the cabinet and sustaining the same. In order to overcome this disadvantage, steps must be taken to augment this loss by increasing the capabilities and ratings of the devices utilized in the refrigeration system for this particular type of cooler.

SUMMARY OF THE INVENTION

The present invention has been devised to obviate the difficulties and disadvantages pointed out above. In the arrangement of the present invention, the evaporator for a refrigeration system is positioned above the space in a cooler cabinet and works in conjunction with one or more fans arranged to direct air from within the chamber across the evaporator coil and downwardly along one wall of the chamber across the bottom thereof and upwardly along the rear wall of the chamber and back into the vicinity of the evaporator in a continuous recirculating airflow. The evaporator and fans are separated from the inner chamber of the cabinet by a perforated wall through which refrigerated air is forced downwardly with the assistance of gravity and across the front of the cooler cabinet. The front of the cabinet is provided with an upwardly swingable door and a lower front door which permits the easy access by small children to the interior of the cooler cabinet and within easy reach of the milk cartons contained therein. A coated wire grate is positioned against the lower portion of the front wall of the cabinet and also along the floor of the cabinet. The grate defines a gap near the front wall and above the cabinet floor that permits the flow of air thereby. In this manner, the milk cartons may be placed upon the wire grate on the floor and against the wire grate spaced from the front wall thereby ensuring the movement of the refrigerated air from the evaporator chamber around the exterior walls of the milk cartons thereby maintaining the same in a cooled environment. The rear panel of the cooler cabinet is provided with a false wall across substantially the entire height and width of the cabinet and between which the air is directed upwardly from the floor chamber to become driven by the fans located adjacent thereto as returned air for continued refrigeration thereof. The present invention also includes a digital thermometer readout device positioned on the front portion of the exterior of a panel slightly angled from the vertical and connected to the upper panel of the cabinet adjacent to the chamber which houses the evaporator thereby ensuring accurate measurement of the refrigerated air at all times.

Therefore, it is the principal object of the present invention to enhance the cooling ability of a milk cooler by directing airflow continuously and efficiently throughout the entire interior of the cooler.

Another advantage of the present invention is to maximize the heat transfer efficiency and maintenance of milk cartons stored in a milk cooler.

Another object of the present invention is to utilize a refrigeration system for use in a milk cooler that is more efficient and at low cost for fabrication and operation of the system.

Still another object of the present invention is to arrange the refrigeration components of a refrigeration system so that maximum utilization of the circulating airflow is attained and retains this capability for a longer period of time when the cooler is exposed to ambient conditions.

Additional objects and advantages of the invention will become apparent from the description which follows and may be learned by practice of the invention. The objects and advantages of the invention may be realized and attained by means of the instrumentalities and combinations particularly pointed out in the appended claims.

The accompanying drawings which are incorporated in and constitute a part of this specification illustrate one embodiment of the invention and together with the description serve to explain the principles of the invention.

BRIEF DESCRIPTION OF THE PREFERRED EMBODIMENT

Reference now will be made in detail to the present preferred embodiment of the present invention, examples of which are illustrated in the accompanying drawings.

Figure 1:
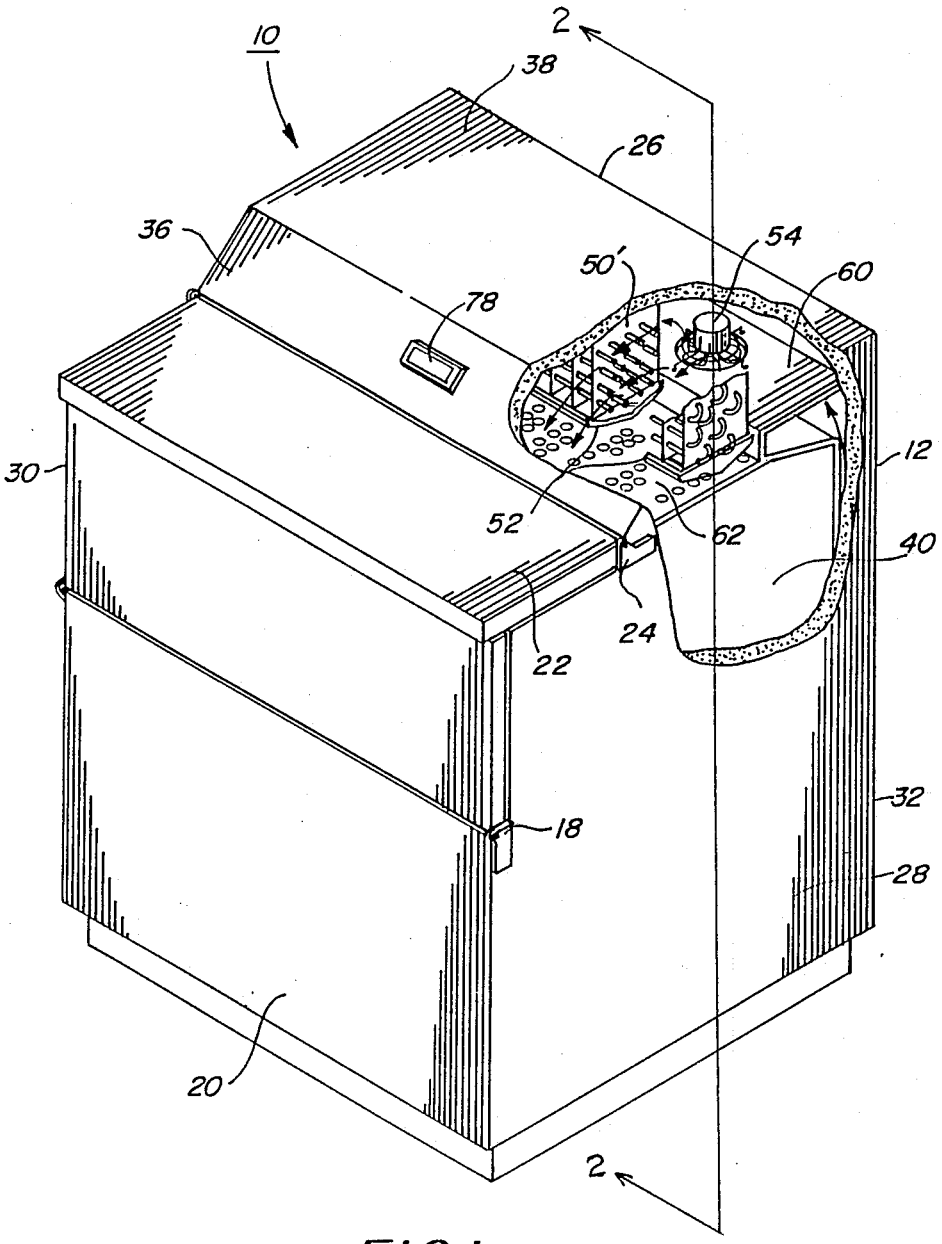
FIG. 1 is a perspective view illustrating a forced air school milk cooler according to the present invention.
Figure 2:
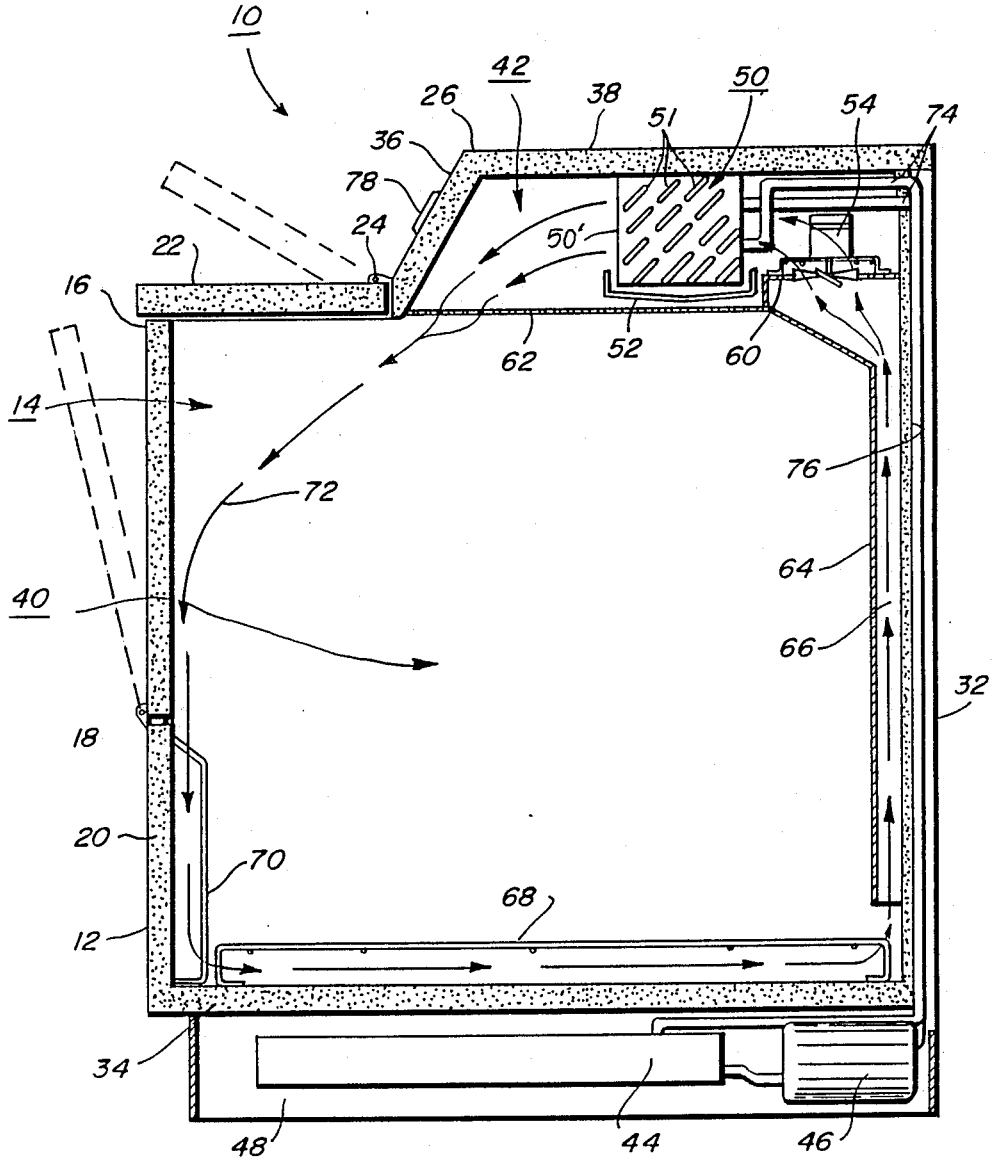
FIG. 2 is a cross-sectional view of the cabinet for the cooler taken along line 2—2 of FIG. 1.

The preferred embodiment of the forced air cooler as shown in FIG. 1 is represented generally by the numeral 10. As shown in FIG. 2, the air cooler 10 is defined by a cabinet 12 having an access opening 14 for customers made available by a double door system comprising a front door 16 suitably hinged along a horizontal axis by hinges 18 relative to a front wall or panel 20 and a top door 22 also mounted for pivotal movement along a horizontal axis by hinges 24.

Completing the structure of the completely insulated cabinet 12, the air cooler includes side panels 28, 30, a rear panel 32 and a floor 34. The hinges 18 for the front door 16 are positioned approximately midway along the height of the front wall 20 and the hinges 24 for the top door 22 are positioned approximately a third of the depth of the top wall 26 thereby limiting the exposure of the space within the cabinet 12 and yet providing adequate access to the articles therein. The top wall 26 includes a panel 36 extending between the side walls 28, 30 and being arranged at a slight angle relative to the vertical and a horizontally oriented upper panel 38 which extends to and is attached to the rear wall 32.

The cabinet 12 defines an enclosure having a main chamber 40 within which articles to-be-cooled are contained during the cooling function of the air cooler. To complete the enclosure, the air cooler 10 includes an upper chamber 42.

As shown schematically in FIG. 2, the air cooler 10 is provided with a refrigeration system comprising a condenser 44 and a compressor 46 suitably arranged and mounted within a space 48 below the floor panel 34. Separation between the main chamber 40 and the space 48 is provided by the floor 34 for the enclosure, the floor including foam insulation in order to insulate the main chamber from the heat developed by the condenser 44 and the compressor 46 and to assist in maintaining the chamber 40 in its refrigerated condition.

Figure 3:
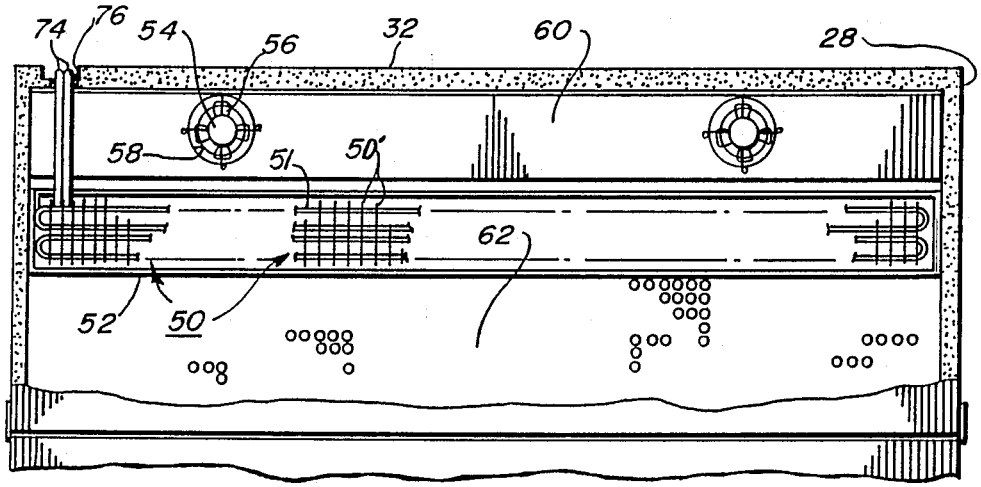
FIG. 3 is a cutaway top plan view of the cabinet.

Within the upper chamber 42, an evaporator 50, having fins 50' and coolant tubes 51, is suitably mounted to the side walls 28, 30 to extend the entire length of the chamber 42 from side wall 28 to the other side wall 30. A drip pan 52 is positioned below the evaporator to catch condensate. Preferably, two or more fans 54 are spaced along the length of the upper chamber 42 between the evaporator 50 and the rear panel 32. As shown in FIG. 3 for example, the fans are suitably supported within the chamber 42 whereby their respective impellers 56 are adapted to rotate within openings 58 formed in a baffle plate 60. The main chamber 40 is separated from the upper chamber 42 by a perforated grille 62 which is mounted in a horizontal plane to the inner surfaces of the top panel 36 and a false wall 64 (described below).

As shown in FIG. 2, the rear panel 32 supports a false wall 64 spaced apart therefrom to form an airflow return channel 66 which extends between side panels 28, 30 and has an exit at its upper end in communication with the interior of the upper chamber 42 through the fan openings 58 and has an entrance at its lower end in communication with the lower portion of the main chamber 40. Along the floor 34, a wire rack or grate 68 is positioned and adapted to support the articles to-be-cooled within the enclosure. A wire rack or grate 70 is preferably coated with an epoxy or plastic coating and is also positioned against the interior surface of the front wall 20 and is arranged to extend between the side walls 28, 30 and from the floor 34 to the lower extension of the access opening 14. Each of the preferably epoxy coated wire racks 68, 70 are spaced from the respective supporting structures a short distance in order to form gaps or channels for air movement and thereby expose different sides of the articles to-be-cooled contained within the main chamber 40.

The fans 54 are arranged within the upper chamber 42 to produce the airflow illustrated in FIG. 2 by the line of arrows. This airflow, as being driven by the fans 54, forces air across the coolant tubes 51 and cooling fins 50' of the evaporator 50, along the upper chamber 42 and downwardly across the access opening 14, downwardly through the front wire rack 70, along the floor 34 of the main chamber 40 within the wire rack 68, then upwardly along the air return channel 66 and again into the vicinity of the fans 54. It has been found that the perforations formed in the grille 62 provides the uniform flow of air being forced from the upper chamber 42 and into the front portion of the main chamber 40 as distinguished from the use of a louvered grille which would normally produce striations of air movement rather than a smooth, uniformly moving air mass. The use of wire grilles along the floor 34 and the front wall 20 insures that each of the articles to be cooled is exposed or rather attains a maximum exposure during operation of the air cooler.

Figure 4:
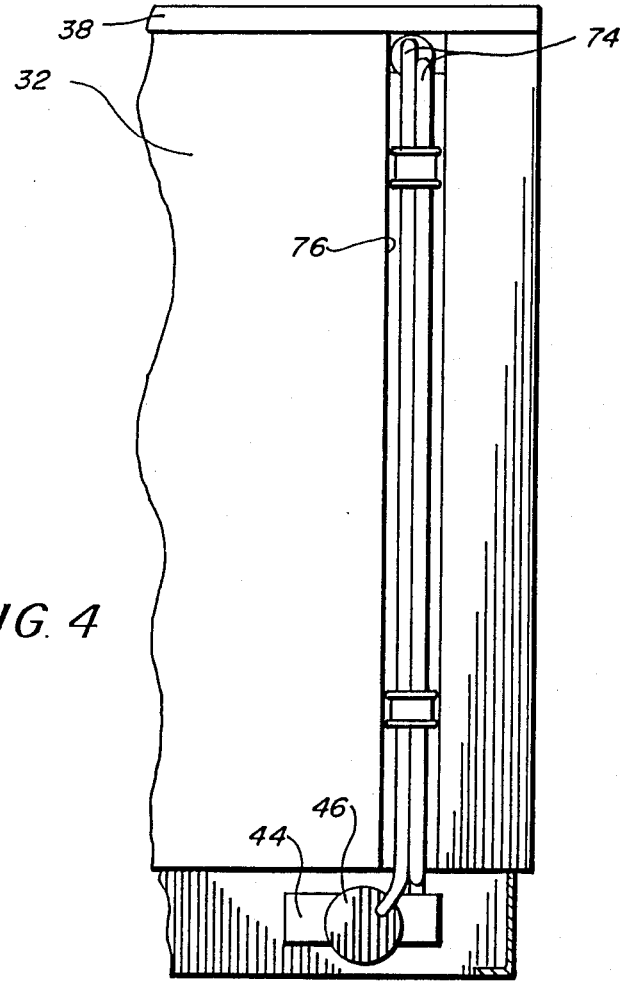
FIG. 4 is a rear view of the cabinet.

To minimize the loss of the insulating effect required from the rear panel 32, the coolant lines 74 from the condenser 44 and compressor 46 are positioned within a groove 76 formed in the rear wall 32, as shown in FIG. 4, thereby minimizing the loss of insulation provided by the rear panel 32. The cabinet 12 is also provided with a digital readout temperature gauge 78 mounted in the panel 36 of the top panel 26. In this arrangement wherein the gauge temperature is affected by the temperature within the upper chamber 42 and away from the access opening 14 which, when the doors 16 and 22 are opened for any length of time, a more accurate indication of temperature within the enclosure is available.

The flow of air produced by the positioning of the fans 54 in the upper location of the enclosure of the cabinet 12 provides an airflow which is adapted to maintain the articles to-be-cooled most efficiently. This is enhanced by the provision and positioning of the wire racks 68, 70, the rear wall 64 and the grille 62 which allows the doors 16, 22 to remain open for a considerable period of time (about 3 to 4 hours) without affecting the desired cooling temperature (preferably between 38° F. to 34° F.) of the articles to-be-cooled. In the arrangement described above, the articles to-be-cooled located within the top space of the cooler will be maintained at the desired cooling temperature as well as those located at the bottom of the enclosure. The arrangement described above produces forced air circulation at all points and spaces around the cabinet resulting in maintaining articles cooler for a longer period of time. In this circulation of air, cooled air is initially driven downwardly with the aid of gravity and into the vicinity of the articles to-be-cooled while the air is at its coolest. The return of the air after losing its coldest condition is returned within a false wall so as not to affect the previously cooled articles.

It will be understood that various changes and modifications may be made in the above described air cooler which provides the characteristics of this invention without departing from the spirit thereof particularly as defined in the following claims.

What is claimed is:

1. A cooler cabinet defining an enclosure for storing articles to-be-cooled, the cabinet comprising:

top, front, rear, floor and side panels enclosing a main chamber for containing the articles, and an upper chamber positioned above said main chamber, said top panel defining a horizontally disposed upper panel joined at an angle to a depending panel, the free end of said depending panel defining an edge of an access opening to said main chamber, said front panel having a free end defining another edge of said access opening;

a top door pivotally connected near said end of said depending panel so as to be pivotable to an open position resting against said depending panel;

a front door pivotally connected near said free end of said front panel;

said top door and said front door providing respective top and front customer access to said access opening;

a false wall spaced apart from said rear panel to form an airflow return channel having an exit at its upper end communicating with the interior of said upper chamber and having an entrance at its lower end disposed in the lower portion of said main chamber;

grate means positioned on said floor panel upon which the articles are placed and against said front panel for permitting the movement of air to flow between the articles and said panels;

a refrigeration system having an evaporator and air distribution means positioned in said upper chamber, said air distribution means being arranged for producing forced-air, circulating movement by drawing air upwardly along said rear panel directly from the lower region of said main chamber into said return channel in a first path of movement, thence across said evaporator to-be-cooled thereby in a second path of movement, thence downwardly into said main chamber along said front panel in a third path of movement, thence along said floor panel in a fourth path of movement and back to said lower region of said main chamber.

2. A cooler cabinet defining an enclosure for storing articles to-be-cooled, the cabinet comprising top, front, rear, floor and side panels enclosing a main chamber for containing the articles, and an upper chamber positioned above said main chamber, grate means for supporting the articles thereupon, said grate means being positioned on said floor panel and against said front panel and defining a gap therebetween for permitting the movement of air to flow between the articles and said panels, a refrigeration system having an evaporator and air distribution means positioned in said upper chamber, said air distribution means being arranged for producing forced-air, circulating movement by drawing air upwardly along said rear panel directly from the lower region of said main chamber in a first path of movement, thence across said evaporator to-be-cooled thereby in a second path of movement, thence downwardly into said main chamber along said front panel in a third path of movement, along said floor panel in a fourth path of movement and back to said lower region of said main chamber, said front panel having an access opening for permitting the storing and removal of articles contained in the cabinet, said access opening being in said third path of air movement.

3. The cooler cabinet as defined in claim 2 wherein said main chamber is separated from said upper chamber by a perforated member through which refrigerated air is moved from said second path of movement to said third path.

4. The cooler cabinet as defined in claim 2 herein said air distribution means includes at least one fan positioned between the end of said first path of air movement and the beginning of said second path of air movement.

5. The cooler cabinet as defined in claim 2 wherein the cabinet includes a lower chamber below said main chamber separated by a wall therefrom for enclosing a condenser and compressor of the refrigeration system.

6. The cooler cabinet as defined in claim 2 including a temperature readout device arranged in said top panel in communication with the interior of said upper chamber and in said first path of air movement.

7. The cooler cabinet as defined in claim 2 wherein said rear panel defines a channel therealong separated from said main chamber by a false wall and along which the circulating air is moved in said first path of air movement.

8. A cooler cabinet defining an enclosure for storing articles to-be-cooled, the cabinet comprising top, front, rear, floor and side panels enclosing a main chamber for containing the articles, and an upper chamber positioned above said main chamber, grate means for supporting the articles thereupon, said grate means being positioned on said floor panel and against said front panel and defining a gap therebetween for permitting the movement of air to flow between the articles and said panels, a refrigeration system having an evaporator and air distribution means positioned in said upper chamber, said air distribution means being arranged for producing forced-air, circulating movement by drawing air upwardly along said rear wall directly from the lower region of said main chamber in a first path of movement, thence across said evaporator to-be-cooled thereby in a second path of movement, thence downwardly into said main chamber along said front wall in a third path of movement, along said floor panel in a fourth path of movement and back to said lower region of said main chamber, said front panel having a first access opening for permitting the storing and removal of articles contained in the cabinet, said first access opening being in said third path of air movement, said top panel having a second access opening for permitting the storing and removal of articles contained in the cabinet, said second access opening being in said second path of air movement.

9. The cooler cabinet as defined in claim 8, further comprising a false wall spaced apart from said rear panel and defining an airflow return channel therealong having an entrance in communication with said grate means and an exit in communication with said upper chamber, said return channel for carrying air moving in said first path of air movement.

* * * * *